US006071201A

United States Patent [19]

Maruko

[11] Patent Number: 6,071,201

[45] Date of Patent: Jun. 6, 2000

[54] SOLID GOLF BALL

[75] Inventor: Takashi Maruko, Chichibu, Japan

[73] Assignee: Bridgestone Sports Co., Ltd., Tokyo, Japan

[21] Appl. No.: 09/132,778

[22] Filed: Aug. 12, 1998

[30] Foreign Application Priority Data

Aug. 14, 1997 [JP] Japan ..... 9-233331

[51] Int. Cl.[7] ..... A63B 37/02; A63B 37/12

[52] U.S. Cl. ..... 473/373; 473/377

[58] Field of Search ..... 473/377, 373; 273/DIG. 22

[56] References Cited

U.S. PATENT DOCUMENTS 4,863,167 9/1989 Matsuki et al. ..... 273/DIG. 22

5,368,304 11/1994 Sullivan et al. ..... 473/377

FOREIGN PATENT DOCUMENTS 6-23069 2/1994 Japan .

6-170012 6/1994 Japan .

*Primary Examiner*—Sebastiano Passaniti

*Attorney, Agent, or Firm*—Sughrue, Mion, Zinn, Macpeak & Seas, PLLC

[57] ABSTRACT

A solid golf ball comprises a solid core and a cover. The solid core has a multilayer construction with an inner core layer and an outer core layer. The inner core layer is composed primarily of a resin, and has a diameter of 15–25 mm and a Shore D hardness of 55–90. The outer core layer is formed of a polybutadiene base rubber composition and has a JIS-C hardness of 35–75. The cover has a thickness of 0.5–3 mm. The ball provides an increased carry when hit by a low head speed player, as well as better durability and feel.

13 Claims, 1 Drawing Sheet

SOLID GOLF BALL

This invention relates to a solid golf ball suitable for golfers having a relatively low head speed of less than 40 m/s.

BACKGROUND OF THE INVENTION

Numerous attempts have been made to achieve golf balls endowed with both increased carry and a good feel when hit. The approach most commonly taken in solid golf balls has been to alter the hardnesses of the cover and the core.

For example, JP-A 23069/1994 discloses a solid golf ball having a three-layer construction comprising an inner core layer, an outer core layer, and a cover wherein the inner core layer has a diameter of 23 to 35 mm and a Shore D hardness of 30 to 60 and the outer core layer has a Shore D hardness of 30 to 56 As a result a suitable spin is maintained and the rebound characteristics and carry are improved. However, when this solid golf ball is hit at a relatively low head speed of about 35 m/s, the ball is given a low initial velocity, failing to have sufficient carry.

JP-A 170012/1994 describes a solid golf ball in which the inner core layer is made of Surlyn, commonly used as a cover material, that has been foamed ($\rho$=0.2 to 1.0). Yet, the inner core layer is so soft that the ball provides a poor rebound and an inadequate carry.

Because most conventional golf balls are targeted at professional golfers and skilled amateurs, they have been designed for optimal performance in a relatively high head speed range of about 40 to 45 m/s. But these golf balls are often less than ideal for use by relatively low head speed players such as women golfers and seniors who strike the ball at head speeds of less than 40 m/s. If a low head speed golfer plays a shot with a driver, for instance, the speed upon impact (initial velocity) conventional balls acquire will be too low to provide an adequate carry.

SUMMARY OF THE INVENTION

An object of the present invention is to provide a golf ball which is suitable for use by players having a relatively low head speed of under 40 m/s, affording in particular a good carry when hit with a club such as a driver, and which also has excellent durability and a good feel.

The inventor have found the following. In golf balls comprising a solid core enclosed within a cover, wherein the solid core has a multilayer construction in which a center sphere serves as the inner core layer and an outer core layer encloses the inner core layer, stress concentration associated with deformation of the ball at the moment of impact arises in the outer core layer. Then the outer core layer must be made of a highly resilient, readily deformable material. By using in the inner core layer, which does not undergo much deformation, a material that is harder than the material used in the outer core layer, the outer core layer itself can be given a low hardness, thereby allowing a greater concentration of stresses in the highly resilient outer core layer. There can thus be obtained a golf ball having high rebound characteristics, largely on account of the outer core layer, as well excellent durability and feel. Even when hit by a low head speed player, this golf ball can provide an improved initial velocity and is thus capable of exhibiting an outstanding carry.

A golf ball with these properties can only be obtained by using as the inner core layer a material having a high hardness and a low resilience. However, only a limited hardness can be obtained using the rubber compositions familiar to the art as inner core layer materials. Moreover, these rubber compositions must be kneaded, extruded, and vulcanized, which reduces productivity.

In this connection, we have discovered that when the inner core layer of a golf ball is composed primarily of a resin and the outer core layer is formed of a polybutadiene base rubber composition, when the inner core layer has a high hardness and the outer core layer has a low hardness, and when the cover has a thickness within a specific range, there can be obtained a golf ball having a large deformation in the outer core layer and high rebound characteristics. Not only is this golf ball capable of providing an increased carry, the initial velocity even when hit by a relatively low head speed player can be improved. Moreover, the synergistic effects of the soft outer core layer and the hard inner core layer result in a golf ball which, instead of being merely soft as in the case of the prior art, has an excellent, soft feel that gives the player an accurate sense of the impact when hitting the ball.

Based upon these findings, the present invention provides a solid golf ball comprising a solid core and a cover that encloses the solid core. The solid core has a multilayer construction consisting of an inner core layer and an outer core layer that encloses the inner core layer. The inner core layer is composed primarily of a resin and has a diameter of 15 to 25 mm and a Shore D hardness of 55 to 90. The outer core layer is formed of a polybutadiene base rubber composition and has a JIS-C hardness of 35 to 75. The cover has a thickness of 0.5 to 3 mm.

In preferred embodiments of the invention, the inner core layer has a specific gravity of 1.1 to 1.65 and an Izod impact strength of at least 30 J/m, and the outer core layer has a specific gravity of 1.05 to 1.25. The golf ball typically undergoes a deformation of 2.4 to 3.8 mm under a load of 100 kg.

The objects, features and advantages of the invention will become more apparent from the following detailed description.

BRIEF DESCRIPTION OF THE DRAWING

The only figure.

DETAILED DESCRIPTION OF THE INVENTION

Figure 1:
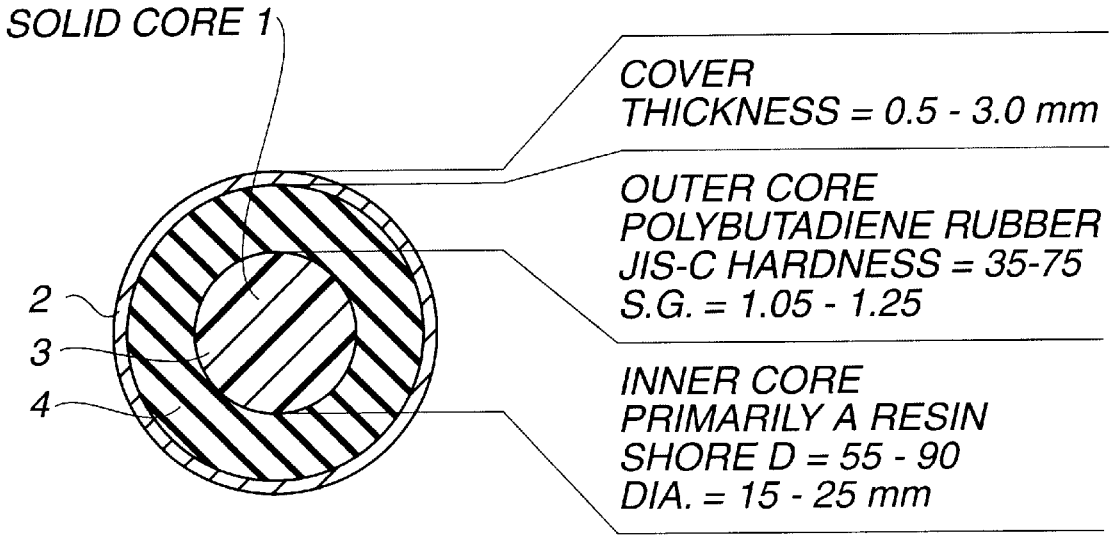
FIG. 1 is a sectional view of a solid golf ball according to one embodiment of the present invention.

Referring to FIG. 1, the solid golf ball of the present invention comprises a solid core 1 and a cover 2 which encloses the solid core 1. The solid core 1 has a two-layer construction consisting of an inner core layer 3 serving as a center sphere and an outer core layer 4 which encloses the surface of the inner core layer 3. About the solid core 1 is formed a single layer cover 2. Although the solid golf ball shown in FIG. 1 has a solid core 1 formed of two layers and a cover 2 formed of one layer, the cover may have a multilayer construction with two, three or more layers if necessary. Moreover, within the scope allowed by the above provisions, one or both of the inner core layer and the outer core layer may have a multilayer construction.

The inner core layer 3 of the solid core 1 is not made of a rubber composition as in conventional golf balls. Instead, it is composed primarily of resin, which allows it to have a greater hardness than conventional cores. The Shore D hardness of the inner core layer 3 in this invention is from 55 to 90, and preferably from 50 to 80. The hard inner core layer 3, combined with the soft, highly resilient outer core layer 4 to be described subsequently, is effective in providing a good feel when the ball is hit.

Resins suitable for use in the inner core layer include thermoplastic resins and thermoplastic elastomers known in the art. Illustrative examples include nylons, polyarylates, ionomer resins, polypropylene resins, thermoplastic polyurethane elastomers, and thermoplastic polyester elastomers. Some examples of suitable commercial products are Surlyn AD 8512 (an ionomer resin manufactured by DuPont Company), Himilan 1706 and 1707 (both ionomer resins manufactured by DuPont-Mitsui Polychemicals K.K.), Rilsan BMNO (a nylon resin manufactured by Toray K.K.), and U-Polymer U-8000 (a polyarylate resin manufactured by Unitika K.K.).

Where desired, an inorganic filler such as barium sulfate, titanium dioxide or zinc oxide may also be compounded as a weight modifier within the resin material. The weight of the inner core layer can be increased by compounding a large amount of such filler, which makes it possible to greatly enhance the rebound characteristics of the golf ball by raising the proportion of rubber components in the outer core layer described subsequently. The amount of weight modifier compounded in the resin material may be set within a range of 0 to 115 parts by weight, and preferably 10 to 100 parts by weight, per 100 parts by weight of the resin. The inner core layer is preferably adjusted to a specific gravity of 1.1 to 1.65, and more preferably 1.2 to 1.55.

The inner core layer of the solid golf ball in this invention preferably has an Izod impact strength of at least 30 J/m, and more preferably from 50 to 120 J/m, the Izod impact strength being measured by the notched Izod impact test of ASTM-256. With an Izod impact strength of less than 30 J/m, the ball would have too low strength to provide an adequate durability against repeated hits.

The inner core layer may be produced by injection molding. In one appropriate process, the inner core layer material is injected into the cavity of a core-forming mold.

The inner core layer formed as described above should have a diameter of 15 to 25 mm, and preferably 18 to 23 mm. An inner core diameter of less than 15 mm can result in an initial velocity greater than the R&A initial velocity, whereas a diameter greater than 25 mm leads to an unacceptably low initial velocity and durability.

The outer core layer 4 of the solid golf ball according to the present invention encloses the above-described inner core layer 3. This outer core layer 4 is made of a polybutadiene base rubber composition and has a lower hardness than the inner core layer 3. More specifically, it has a JIS-C hardness of from 35 to 75, and preferably from 48 to 72.

The hardness specifications for the respective core layers in the invention are given here in terms of the Shore D hardness for the inner core layer and the JIS-C hardness for the outer core layer. Because a Shore D hardness of 55 corresponds to a JIS-C hardness of about 80 or more, the Shore D hardness range of 55 to 90 for the inner core layer represents a greater hardness than the JIS-C hardness range of 35 to 75 for the outer core layer.

It is essential for the purpose of this invention that polybutadiene be employed as the base material in the rubber composition making up the outer core layer. The use of 1,4-cispolybutadiene having a cis structure of at least 40% is especially suitable. Where desired, natural rubber, polyisoprene rubber, styrene-butadiene rubber or the like may be suitably compounded in this base rubber. However, because a higher proportion of polybutadiene increases the rebound characteristics of the golf ball, these other ingredients should preferably be compounded in an amount of not more than 10 parts by weight per 100 parts by weight of the polybutadiene.

A crosslinking agent may be blended into the rubber composition. Examples include the zinc salts and magnesium salts of unsaturated fatty acids, such as zinc methacrylate and zinc acrylate, and ester compounds such as trimethylpropane methacrylate. Of these, the use of zinc acrylate is especially preferred because of the high resilience this provides. These crosslinking agents are preferably compounded in an amount of from 10 to 30 parts by weight per 100 parts by weight of the base rubber.

A vulcanizing agent is often compounded within the rubber composition of the outer core layer. It is recommended that this vulcanizing agent contain a peroxide having a 1-minute half-life temperature of not more than 155 C, the amount of this peroxide being at least 30% by weight, and especially 40 to 70% by weight, of the overall amount of vulcanizing agent. Examples of suitable peroxides include commercially available products such as Perhexa 3M (manufactured by Nippon Oils and Fats K.K.). The amount of vulcanizing agent blended into the rubber composition may be set at preferably from 0.6 to 2 parts by weight per 100 parts by weight of the base rubber.

Other suitable ingredients may also be compounded into the rubber composition, including antioxidants, and fillers such as zinc oxide and barium sulfate for adjusting the specific gravity. These specific gravity modifiers are preferably blended in an amount of from 1 to 30 parts by weight per 100 parts by weight of the base rubber.

The outer core layer is preferably adjusted to a specific gravity of from 1.05 to 1.25, and more preferably from 1.05 to 1.2.

The outer core layer 4 in the invention may be produced by molding and vulcanizing or curing the above rubber composition in a known manner. For example, advantageous use may be made of a method in which vulcanization is divided into two steps. In the first step, the outer core layer material is placed in an outer core layer-forming mold and subjected to primary vulcanization (semi-vulcanization), thereby producing a pair of hemispherical half-cups. Next, a pre-formed inner core layer is placed in one of the hemispherical half-cups, the other half-cup is closed over this, and secondary vulcanization (full vulcanization) is carried out. That is, the solid core is completed at the same time as the formation of the outer core layer. Also a method of injection molding the outer core layer material over the preformed inner core layer is suitable. Formation of the outer core layer requires a vulcanizing step, in the course of which the inner core layer can be heated to an elevated temperature. For this reason, it is preferable that the inner core layer material have a melting point of at least 150C.

An adhesive may be applied to the inner core layer before it is placed in the hemispherical half-cups (to form the outer core layer). The adhesive provides a secure bond at the interface between the inner and outer core layers, thereby enhancing the durability of the golf ball and helping to achieve a high rebound. To increase the adhesion between the inner and outer core layers, it is advisable to roughen the surface of the inner core layer in a tumbler or the like to form minute irregularities on the surface before placing the inner core layer within the outer core layer.

The solid core 1 produced in the above-described manner generally has a diameter of 36.5 to 41.5 mm, and preferably 38.5 to 41.5 mm.

The golf ball of the present invention has a cover 2 which is formed so as to enclose the above-described solid core 1. The cover 2 may be formed of a known cover material, and has a thickness of 0.5 to 3 mm, and preferably 1 to 2 mm. The cover preferably has a Shore D hardness of 50 to 65, and more preferably 55 to 65. A specific gravity of 0.95 to 1.25 is advantageous. As noted earlier, the cover may have a multilayer construction.

Known cover materials may be used in the cover 2. For example, ionomer resins and balata rubber are useful as well as thermoplastic elastomers such as polyurethane, polyamide, and polyester elastomers. The cover may be advantageously formed by a conventional injection molding process.

The solid golf ball formed as described above preferably has a deformation of 2.4 to 3.8 mm, and especially 2.6 to 3.5 mm, when a load of 100 kg is applied.

As in conventional golf balls, the golf ball of this invention has a plurality of dimples formed on the surface of the cover. The total number of dimples is preferably from 350 to 500, more preferably from 370 to 480, and even more preferably from 390 to 450. The dimples may have a geometric arrangement that is octahedral or icosahedral, for example. Nor is the dimple pattern limited to a circular pattern, the use of any other suitable pattern, such as a square, hexagonal, pentagonal, or triangular pattern, also being acceptable.

The diameter, depth, and cross-sectional shape of the dimples may be optimized to improve the carry of the ball. Dimples may be provided so that the dimple surface coverage, which is defined as the surface area of ball occupied by dimples divided by the total surface area of ball and expressed as a percentage, is 65% or more, and preferably 70 to 80%. At a dimple surface coverage of less than 65%, an increased flight distance might not be obtained. The dimple volume ratio, which is defined as the total volume of dimples divided by the volume of ball and expressed as a percentage, may be set at 0.76 to 1.0%, and preferably 0.78 to 0.94%. A dimple volume ratio of less than 0.76% would result in too high a trajectory whereas a volume ratio of more than 1.0% would result in too low a trajectory, the effect of either being a decrease in the carry of the ball.

The solid golf ball of the invention may be formed so as to have a diameter of not less than 42.67 mm and a weight of not greater than 45.93 g in accordance with the Rules of Golf.

The solid golf ball of this invention, as described herein, provides increased carry even when hit by a relatively low head speed player. In addition, the ball has an improved durability and a better feel.

EXAMPLE

Examples of the invention and comparative examples are given below by way of illustration, and are not intended to limit the invention.

Examples 1–6 and Comparative Examples 1–7

The resin compositions shown in Table 1 were injected into an injection mold to produce inner core layers having the diameters indicated in Tables 4 and 5. The surfaces of the resulting inner core layers were then roughened in a tumbler. In Comparative Example 3, an inner core layer was produced using the rubber composition shown in Table 3.

The rubber compositions shown in Tables 2 and 3 were kneaded in a roll mill, then molded and subjected to primary vulcanization (semi-vulcanization) in a mold at 120 C for 6 minutes to form a pair of hemispherical half-cups.

The above inner core layer was enclosed within the resulting pair of hemispherical half-cups, and the outer core layer was subjected to secondary vulcanization (full vulcanization) within a mold at 155 C for 15 minutes, thereby giving a solid core having a two-layer construction. An outer core layer was not formed in Comparative Example 7.

The cover stock described below was injection molded about the respective solid cores thus obtained to form in each case a cover having a thickness of 1.8 mm and 392 dimples (with a dimple surface coverage of 78% and a dimple volume ratio of 0.88%), thereby giving solid golf balls having the properties shown in Tables 4 and 5.

| Cover Stock: | Parts by weight |
|---|---|
| Ionomer resin A* | 50.0 |
| Ionomer resin B* | 50.0 |
| Titanium oxide | 5.0 |
| Dispersant and pigment | 1.2 |
| Shore D hardness | 61 |

*Ionomer resin A: Himilan 1605 (Dupont-Mitsui Polychemicals K.K.)
Ionomer resin B: Himilan 1706 (Dupont-Mitsui Polychemicals K.K.)

The golf balls thus obtained were evaluated as described below. The results are given in Tables 4 and 5.

Flight Performance

The golf balls were measured for initial velocity, angle of elevation, carry, and total distance when hit with a driver (#1W) at head speeds of 45 m/s (HS45), 40 m/s (HS40), and 35 m/s (HS35) using a swing robot.

Durability

Using a swing robot, thirty balls of each type were hit 100 times with a driver (#1W) at a head speed of 45 m/s. The number of balls that cracked or split were counted.

Feel

The balls were hit by three professional golfers with a driver, and the golfers evaluated the feel of each ball using as the reference the ball in Comparative Example 7.

VS: Very soft

S: Similar to reference ball

H: Hard

TABLE 1

| Inner core layer (parts by weight) | a | b | c | d |
|---|---|---|---|---|
| Ionomer resin (Surlyn AD8512, from DuPont Co.) | — | 100 | — | — |
| Polyamide resin (Rilsan BMNO, from Toray) | 100 | — | — | — |
| Polyarylate resin (U-Polymer U-8000, from Unitika) | — | — | 100 | — |
| Polypropylene resin (Polypro J-700G, from Idemitsu) | — | — | — | 100 |
| Barium sulfate | 43.3 | 61 | — | — |
| Dispersant and pigment | 1.2 | 1.2 | — | — |
| Shore D hardness | 80 | 65 | 89 | 80 |
| Melting point (∞ C.) | 186 | 87 | 230 | 160 |
| Izod impact strength[1)] (J/m) | 50 | did not break | 108 | 22 |

[1)]Values obtained by measurement of notched specimens according to ASTM-256.

TABLE 2

| Outer core layer (parts by weight) | e | f | g | h | i | j | k |
|---|---|---|---|---|---|---|---|
| cis-1,4-Polybutadiene (JSR BR01, from Japan Synthetic Rubber) | 100 | 100 | 100 | 100 | 100 | 100 | 100 |
| Zinc oxide | 10 | 10 | 10 | 10 | 10 | 5 | 10 |
| Zinc acrylate | 24 | 24 | 24 | 17 | 24 | 24 | 5 |
| Barium sulfate | 9 | 6.8 | 1.9 | 10 | 11.1 | 0.9 | 15.6 |
| Peroxide (Percumyl D, from Nippon Oils & Fats) | 0.4 | 0.4 | 0.4 | 0.4 | 0.4 | 0.4 | 0.4 |
| Peroxide (Perhexa 3M, from Nippon Oils & Fats) | 0.8 | 0.8 | 0.8 | 0.8 | 0.8 | 0.8 | 0.8 |
| Vulcanizing conditions[2)] | A | A | A | A | A | A | A |

[2)]Vulcanizing Conditions
A - Semi-vulcanization: 120 C., 6 minutes (primary vulcanization) Full vulcanization: 155 C., 15 minutes (secondary vulcanization)
B - Full vulcanization: 155 C., 15 minutes

TABLE 3

| Inner and outer core layers (parts by weight) | l | m | n | o |
|---|---|---|---|---|
| cis-1,4-Polybutadiene (JSR BR01, from Japan Synthetic Rubber) | 100 | 100 | 100 | 100 |
| Zinc oxide | 5 | 10 | 10 | 10 |
| Zinc acrylate | 42 | 24 | 28 | 30 |
| Barium sulfate | 3.7 | 25.8 | 10.7 | 20.7 |
| Peroxide (Percumyl D, from Nippon Oils & Fats) | 0.4 | 0.4 | 0.4 | 0.4 |
| Peroxide (Perhexa 3M, from Nippon Oils & Fats) | 0.8 | 0.8 | 0.8 | 0.8 |
| Vulcanizing conditions[2)] | A | A | A | B |

[2)]Vulcanizing Conditions
A - Semi-vulcanization: 120 C., 6 minutes (primary vulcanization) Full vulcanization: 155 C., 15 minutes (secondary vulcanization)
B - Full vulcanization: 155 C., 15 minutes

TABLE 4

| | Examples | | | | | |
|---|---|---|---|---|---|---|
| | 1 | 2 | 3 | 4 | 5 | 6 |
| Specifications | | | | | | |
| Inner core layer | a | a | a | b | c | a |
| Outer core layer | e | f | g | f | e | h |
| Inner core layer | | | | | | |
| Diameter (mm) | 16.1 | 20.1 | 24.1 | 20.1 | 20.1 | 20.1 |
| Weight (g) | 3.0 | 5.7 | 9.9 | 5.7 | 5.4 | 5.7 |
| Specific gravity | 1.350 | 1.350 | 1.350 | 1.350 | 1.279 | 1.350 |
| Shore D | 80 | 80 | 80 | 65 | 89 | 80 |
| Outer core layer | | | | | | |
| Diameter (mm)*1 | 39.1 | 39.1 | 39.1 | 39.1 | 39.1 | 39.1 |
| Thickness (mm) | 11.5 | 9.5 | 7.5 | 9.5 | 9.5 | 9.5 |

TABLE 4-continued

| | Examples | | | | | |
|---|---|---|---|---|---|---|
| | 1 | 2 | 3 | 4 | 5 | 6 |
| Weight (g) | 36.0 | 36.1 | 36.1 | 36.1 | 36.1 | 36.1 |
| Specific gravity | 1.135 | 1.122 | 1.093 | 1.122 | 1.135 | 1.122 |
| JIS-C | 70 | 70 | 70 | 70 | 70 | 55 |
| Ball | | | | | | |
| Diameter (mm) | 42.7 | 42.7 | 42.7 | 42.7 | 42.7 | 42.7 |
| Weight (g) | 45.2 | 45.3 | 45.3 | 45.3 | 45.3 | 45.3 |
| Hardness (mm)*2 | 3.1 | 3.0 | 2.9 | 3.1 | 3.0 | 3.6 |
| Cover thickness (mm) | 1.8 | 1.8 | 1.8 | 1.8 | 1.8 | 1.8 |
| Durability | 0/30 | 0/30 | 0/30 | 0/30 | 0/30 | 0/30 |
| Feel | VS | VS | VS | VS | VS | VS |
| Flight Test HS45 m/s #1W | | | | | | |
| Initial velocity (m/s) | 66.6 | 66.5 | 66.3 | 66.5 | 66.2 | 66.1 |
| Angle of elevation (∞) | 12.2 | 12.3 | 12.2 | 12.2 | 12.2 | 12.0 |
| Carry (m) | 212.3 | 210.7 | 209.7 | 209.9 | 210.4 | 208.3 |
| Total (m) | 221.0 | 220.1 | 218.9 | 220.2 | 219.2 | 218.4 |
| Flight Test HS40 m/s #1W | | | | | | |
| Initial velocity (m/s) | 59.5 | 59.6 | 59.4 | 59.7 | 59.6 | 59.6 |
| Angle of elevation (∞) | 11.8 | 11.9 | 12.0 | 11.9 | 12.1 | 11.9 |
| Carry (m) | 180.7 | 181.6 | 181.6 | 183.3 | 182.2 | 184.4 |
| Total (m) | 190.3 | 190.8 | 190.8 | 192.0 | 190.7 | 192.5 |
| Flight Test HS35 m/s #1W | | | | | | |
| Initial velocity (m/s) | 48.3 | 48.4 | 48.3 | 48.3 | 48.3 | 48.5 |
| Angle of elevation (∞) | 12.3 | 12.3 | 12.4 | 12.4 | 12..3 | 12.4 |
| Carry (m) | 131.6 | 132.5 | 131.7 | 130.3 | 131.2 | 136.4 |
| Total (m) | 146.8 | 147.4 | 145.4 | 145.2 | 145.8 | 146.4 |

*1Diameter of solid core when an outer core layer was formed over an inner core layer.

*2Deformation of the ball under a load of 100 kg.

TABLE 5

| | Comparative Examples | | | | | | |
|---|---|---|---|---|---|---|---|
| | 1 | 2 | 3 | 4 | 5 | 6 | 7 |
| Specifications | | | | | | | |
| Inner core layer | a | a | o | a | a | d | n |
| Outer core layer | I | j | f | k | l | m | — |
| Inner core layer | | | | | | | |
| Diameter (mm)*1 | 12.1 | 27.1 | 20.1 | 20.1 | 20.1 | 24.1 | 39.1 |
| Weight (g) | 1.3 | 14.1 | 5.7 | 5.7 | 5.7 | 6.6 | 36.1 |
| Specific gravity | 1.350 | 1.350 | 1.350 | 1.350 | 1.350 | 0.905 | 1.155 |
| Shore D | 80 | 80 | 51 | 80 | 80 | 80 | 76 |
| Outer core layer | | | | | | | |
| Diameter (mm) | 39.1 | 39.1 | 39.1 | 39.1 | 39.1 | 39.1 | — |
| Thickness (mm) | 13.5 | 6.0 | 9.5 | 9.5 | 9.5 | 7.5 | — |
| Weight (g) | 36.1 | 36.1 | 36.1 | 36.1 | 36.1 | 36.1 | — |
| Specific gravity | 1.147 | 1.055 | 1.122 | 1.122 | 1.122 | 1.230 | — |
| JIS-C | 70 | 70 | 70 | 40 | 89 | 70 | — |
| Ball | | | | | | | |
| Diameter (mm) | 42.7 | 42.7 | 42.7 | 42.7 | 42.7 | 42.7 | 42.7 |
| Weight (g) | 45.3 | 45.3 | 45.3 | 45.3 | 45.3 | 45.3 | 45.3 |
| Hardness (mm)*2 | 3.2 | 2.9 | 3.9 | 3.9 | 2.5 | 2.9 | 2.8 |
| Cover thickness (mm) | 1.8 | 1.8 | 1.8 | 1.8 | 1.8 | 1.8 | 1.8 |
| Durability | 0/30 | 0/30 | 0/30 | 0/30 | 0/30 | 6/30 | 0/30 |
| Feel | S | H | VS | H | H | VS | reference |
| Flight Test HS45 m/s #1W | | | | | | | |
| Initial velocity (m/s) | 66.7 | 65.7 | 66.5 | 66.0 | 66.6 | 65.9 | 66.7 |
| Angle of elevation (∞) | 11.9 | 11.6 | 11.9 | 11.6 | 12.3 | 12.0 | 11.8 |
| Carry (m) | 212.0 | 205.1 | 212.3 | 208.7 | 212.5 | 208.6 | 211.8 |
| Total (m) | 221.5 | 214.5 | 219.8 | 218.6 | 217.3 | 215.3 | 221.6 |
| Flight Test HS40 m/s #1W | | | | | | | |
| Initial velocity (m/s) | 59.2 | 57.4 | 59.3 | 58.2 | 59.2 | 58.5 | 59.2 |
| Angle of elevation (∞) | 11.6 | 11.0 | 11.5 | 12.1 | 12.9 | 11.9 | 11.7 |
| Carry (m) | 179.5 | 169.5 | 178.7 | 178.2 | 180.6 | 177.2 | 180.3 |
| Total (m) | 188.6 | 178.3 | 187.2 | 186.8 | 187.9 | 185.7 | 189.4 |
| Flight Test HS35 m/s #1W | | | | | | | |
| Initial velocity (m/s) | 48.0 | 47.0 | 47.9 | 47.2 | 47.5 | 47.4 | 48.0 |
| Angle of elevation (∞) | 12.4 | 11.4 | 12.3 | 12.6 | 13.1 | 12.2 | 12.5 |
| Carry (m) | 130.5 | 120.8 | 129.4 | 128.9 | 129.2 | 127.3 | 130.2 |
| Total (m) | 142.6 | 135.8 | 143.1 | 139.2 | 137.7 | 136.1 | 142.8 |

*1Diameter of solid core when an outer core layer was formed over an inner core layer. In Comparative Example 7, the diameter of the single-layer solid core is given.
*2Deformation of the ball under a load of 100 kg.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising; a solid core and a cover enclosing the solid core, said solid core having a multilayer construction consisting of an inner core layer and an outer core layer enclosing the inner core layer, wherein said inner core layer comprises a resin and has a diameter in the range of 15 to 25 mm, a Shore D hardness in the range of 55 to 90, and a specific gravity of higher than a specific gravity of the outer core layer, said outer core layer is formed of a polybutadiene base rubber composition and has a JIS-C hardness in the range of 35 to 75, and said cover has a thickness in the range of 0.5 to 3 mm.

2. The solid golf ball of claim 1, wherein the inner core layer has a specific gravity of 1.1 to 1.65, and the outer core layer has a specific gravity of 1.05 to 1.25.

3. The solid golf ball of claim 1, wherein the inner core layer has an Izod impact strength of at least 30 J/m.

4. The solid golf ball of claim 1 having a deformation of 2.4 to 3.8 mm under a load of 100 kg.

5. The solid golf ball of claim 1, wherein the specific gravity of the inner core layer is in the range of 1.2 to 1.55.

6. The solid golf ball of claim 1, wherein the specific gravity of the outer core layer is in the range of 1.05 to 1.20.

7. The solid golf ball of claim 1, wherein the resin of the inner core layer include nylons, polyarylates, ionomer resins, polypropylene resins, thermoplastic polyurethane elastomers, and thermoplastic polyester elastomers.

8. The solid golf ball of claim 1, wherein said inner core layer has a Shore D hardness in the range of 50 to 86.

9. The solid golf ball of claim 1, wherein said inner core layer has an Izod impact strength in the range of 50 to 120 J/m.

10. The solid golf ball of claim 1, wherein said outer core layer has a JIS-C hardness in the range of 48 to 72.

11. The solid golf ball of claim 1, wherein said outer core layer has a specific gravity in the range.

12. The solid golf ball of claim 1, wherein said cover has a Shore D hardness in the range of 50 to 65.

13. The solid golf ball of claim 1, wherein said cover has a specific gravity in the range of 0.95 to 1.25.

* * * * *